United States Patent [19]

Grosbard

[11] Patent Number: 4,860,370

[45] Date of Patent: Aug. 22, 1989

[54] MAGNETICALLY SUSPENDED ACOUSTICAL SPEAKER

[76] Inventor: Gregory Grosbard, 16353 NW. 57th Avenue, Miami, Fla. 33014

[21] Appl. No.: 155,601

[22] Filed: Feb. 12, 1988

[51] Int. Cl.[4] ..... H04R 9/04

[52] U.S. Cl. ..... 381/197

[58] Field of Search ..... 381/197, 199, 96, 200, 381/204, 201

[56] References Cited

U.S. PATENT DOCUMENTS 4,243,838 1/1981 Coffey ..... 381/194

4,327,257 4/1982 Schwartz ..... 381/197

4,550,430 10/1985 Meyers ..... 381/96

4,609,784 9/1986 Miller ..... 381/96

*Primary Examiner*—Forester W. Isen

*Attorney, Agent, or Firm*—Fleit, Jacobson, Cohn, Price, Holman & Stern

[57] ABSTRACT

The diaphragm of an acoustic loudspeaker is suspended by means of the force of a magnetic field applied along a gravitational load axis to avoid direct or indirect physical contact with the support during drive of the diaphragm by an electrical signal. Displacement of the speaker along the gravitational axis is sensed to regulate operation of the amplifier through which the driving signal is applied to the voice coil supported by the diaphragm.

21 Claims, 2 Drawing Sheets

MAGNETICALLY SUSPENDED ACOUSTICAL SPEAKER

BACKGROUND OF THE INVENTION

Field of the Invention

This invention relates to the support or suspension of an electrically driven diaphragm of an acoustical loudspeaker.

It is generally known that the support of the sound radiating diaphragm of an acoustical speaker affects the quality or distortion of the sound being reproduced from an electrical driving signal usually applied through an amplifier to a voice coil fixed to the diaphragm and positioned within a magnetic circuit. In an effort to reduce distortion, various diaphragm supporting arrangements and suspension means have been proposed including pressurized air support, electrostatic devices and energy absorbing devices. Diaphragm supporting arrangements for such purposes are disclosed for example in U.S. Pat. Nos. 3,684,052 and 4,384,174 to Sotome and Suzuki et al., respectively. An acoustical energy absorbing arrangement, on the other hand, is disclosed in U.S. Pat. No. 4,256,198 to Kawakami, et al. In all of such prior art arrangements, there is some energy absorption involved occasioned by the diversion of acoustical driving forces. Therefore, the extent to which sound reproduction quality may be improved in accordance with present theories is limited by physical contact or mechanical attachment, whether direct or indirect, between the frame structure of the loudspeaker and its radiating diaphragm. The problem is particularly acute for base speakers where the elimination of distortion is desirable.

The concept of supporting the gravitational loads of rotors by magnetic field suspension means is already known, as disclosed for example in my prior U.S. Pat. Nos. 3,761,148 and 3,794,391. The application of such magnetic suspension means for support of acoustical diaphragms was not, however, deemed to be a viable option under presently known theories in the acoustical arts. Thus, despite the crowded nature of the acoustical loudspeaker art, the elimination of all physical contact, connection or mechanical attachment between the frame structure and the diaphragm by magnetic means has not been considered, as evident from the disclosures in the more recent patents to Kawakami, et al. and Suzuki, et al., aforementioned.

It is therefore an important object of the present invention to provide a diaphragm supporting suspension system which is capable of improving acoustical reproduction quality beyond the limits inherent in presently known theories.

A further object in accordance with the foregoing object is to provide an improved diaphragm suspension arrangement that is most beneficial in eliminating distortion especially from a base speaker.

SUMMARY OF THE INVENTION

In accordance with the present invention, the diaphragm of an acoustical speaker is suspended without any physical contact with or mechanical attachment to the enclosure or frame during operation. Such suspension of the diaphragm is achieved by exclusive reliance on the resultant repelling force produced by opposing magnetic fields aligned with the gravitational load axis of the diaphragm. One of the magnetic fields is generated by a magnetic armature axially fixed to the diaphragm but physically independent of the frame structure. The armature is positioned in non-interfering relation to the magnetic circuit and voice coil associated with the speaker signal driving means. The other magnetic field is generated by an annular magnet coaxial with the gravitational load axis and fixed to the frame structure with which the speaker is associated.

According to one embodiment of the invention, a sensing coil detects displacement of the armature to a position corresponding to full magnetic suspension of the diaphragm load by the magnetically produced repelling suspension force equal to the weight of the diaphragm. A feedback signal is then fed to the signal driving amplifier coupled to the voice coil of the diaphragm for regulated operation thereof in a more sensitive mode effecting distortion-free sound reproduction.

Physical independence between the diaphragm assembly and the speaker enclosure or frame structure during speaker operation, is characterized by maintenance of an annular air gap between flange portions of the enclosure and diaphragm assembly according to an embodiment of the invention as hereinafter described in detail. Such air gap also acts as an enclosure tuning port varied in dimension by axial displacement of the diaphragm assembly for self-regulated, air relieving purposes.

These together with other object and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a partial side section view through an acoustical loudspeaker assembly constructed in accordance with one embodiment of the invention.

FIGS. 2 and 3 are section views taken substantially through planes indicated by section lines 2—2 and 3—3 in FIG. 1.

FIG. 4 is an electrical circuit diagram illustrating a control system associated with the speaker assembly shown in FIGS. 1–3.

DETAILED DESCRIPTION OF THE PREFERRED EMBODIMENT

Figure 1:
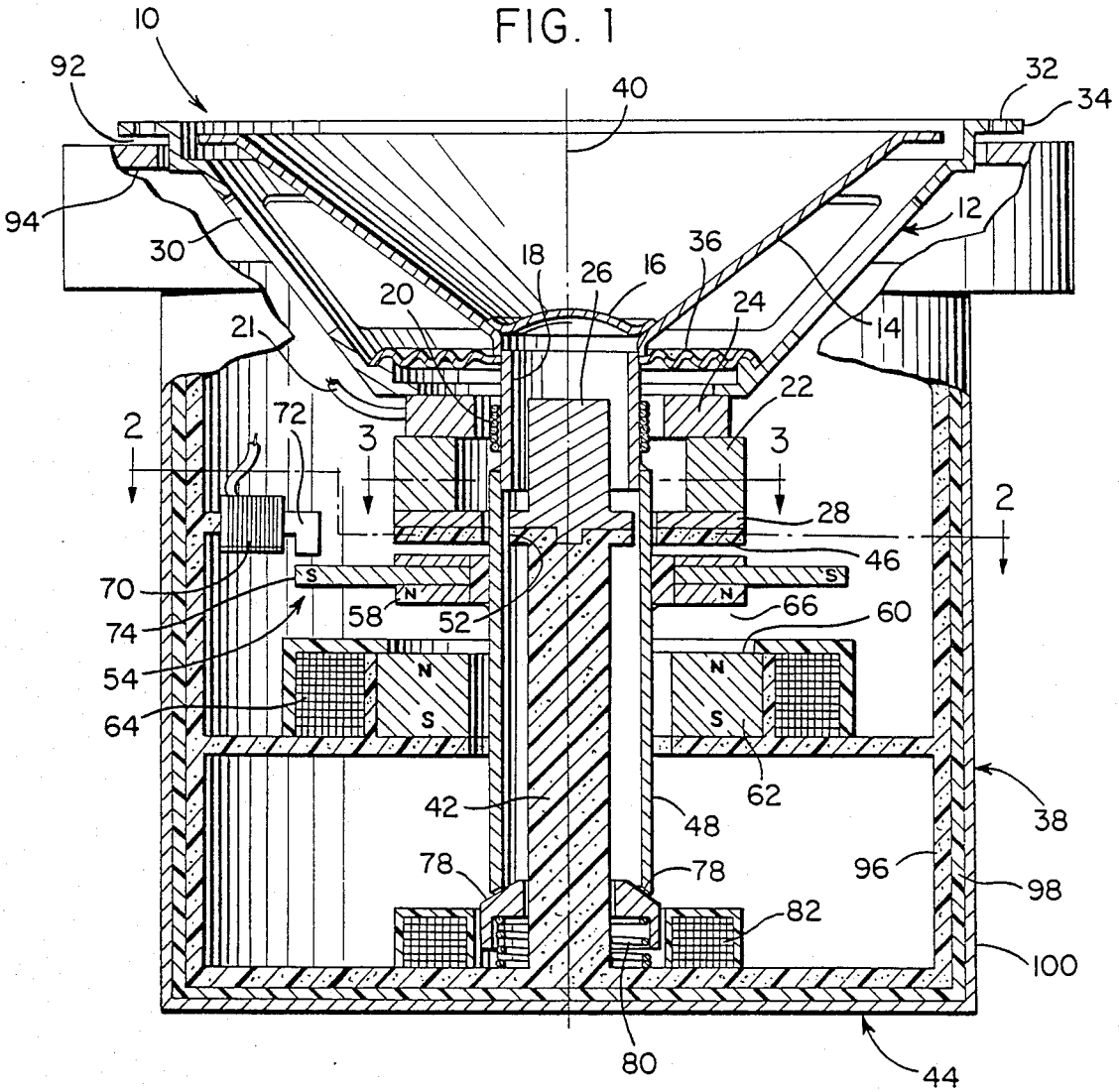
Figure 2:
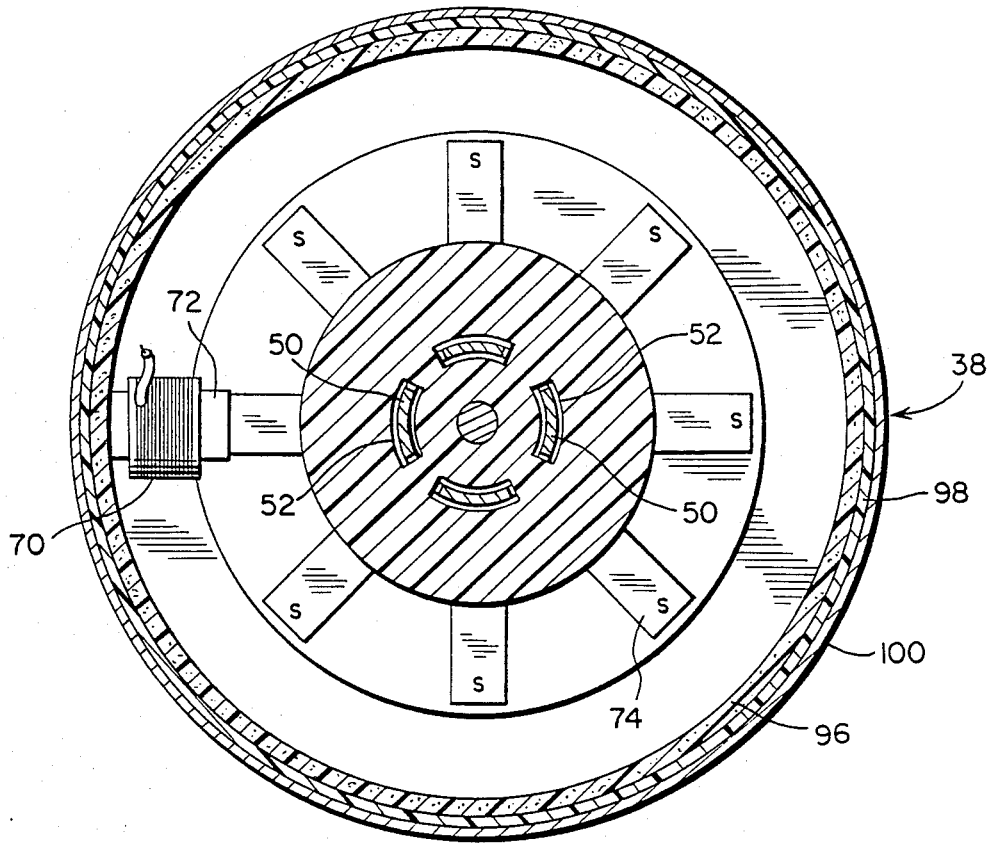
Figure 3:
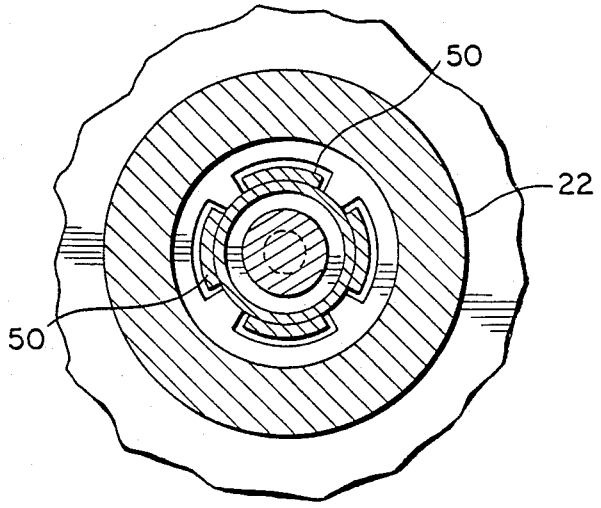

Referring now to the drawings in detail, FIGS. 1, 2 and 3 illustrate by way of example an acoustical loudspeaker assembly generally referred to by reference numeral 10. The speaker assembly is typical in that it includes a conical diaphragm assembly having a framework diaphragm 12, a cone-shaped woofer diaphragm 14 in coaxial relation thereto having a center cap 16 and a tubular support 18 on which a voice coil 20 is mounted. The voice coil is part of a driving unit associated with the diaphragm assembly having a ring shaped permanent magnet 22 on which an annular pole piece 24 is mounted forming an air gap, within which the voice coil is located. A center pole piece 26 extends into the voice coil and is attached by its flange portion 28 to the magnet 22 thereby forming a magnetic circuit between pole pieces. An electrical driving signal fed to the voice coil 20 through signal cable 21 will cause the diaphragm 14 to vibrate and generate sound waves which may escape rearwardly through openings 30 in the diaphragm framework 12 and be radiated forwardly through some baffle (not shown) attached by fasteners extending through openings 32 int he flange 34 of the framework 12. A damper element 36 may interconnect the diaphragm 14, adjacent to the voice coil, to the diaphragm framework. A supporting housing or frame structure 38 encloses the speaker at a desired location and orientation.

In accordance with the present invention, the housing 38 positions the speaker assembly 10 so that the axis 40 of the diaphragm assembly is aligned with a gravitational vertical and faces upwardly for upward radiation of sound from the diaphragm disposed in coaxial relation thereto. Toward that end, a support post 42 extends upwardly from a bottom wall portion 44 of the housing and has a flange portion 46 underlying the flange 28 of center pole piece 26 in the embodiment shown. The load of the speaker assembly is carried on a tubular member 48 arranged in coaxial relation to the post 42. The upper end portion of tubular member 48 is provided with angularly spaced legs 50 projecting through aligned openings 52 in the flanges 28 and 46 for attachment to the diaphragm 14 through its voice coil support tube 18 physically independent of the housing 38 as shown.

Thus, the tubular member 48 loaded along gravitational axis 40 by the diaphragm is adapted to be suspended within housing 38 without any physical contact therewith, connection or mechanical attachment thereto by magnetic means 54 generally similar to that disclosed in my prior U.S. Pat. Nos. 3,761,148 and 3,794,391 aforementioned. The magnetic means 54 includes a magnetic armature assembly 56 axially fixed to the tubular member 48 and spaced below and in non-interfering relation to the magnetic circuit of the speaker diaphragm. The armature assembly has a lower pole face 58 of the same polarity as the pole face 60 of an annular member 62 rendered magnetic by a surrounding electromagnetic coil 64. When energized, the coil 64 will generate a magnetic field which opposes the magnetic field of the armature assembly 56 to produce a resultant repelling force within the annular gap 66 between the pole faces 58 and 60 of the same polarity. Such repelling force for given magnetic field strengths will vary in magnitude with the axial spacing of gap 66 and be aligned with the gravitational load axis 40 in order to overcome the load on the tubular member 48 and maintain it suspended without any physical attachment to the frame structure as aforementioned. The coil 64 and annular magnetic member 62 are axially fixed within the housing 38 by wall 68.

According to the illustrated embodiment, a sensing coil 70 is positioned by its core 72 in close operatively spaced relation to radial pole extensions 74 of the armature assembly in order to detect displacement of the tubular member 48 to its magnetically suspended position during operation of the speaker. While inoperative, the diaphragm 14 of the speaker may be supported through the tubular member 48 on an annular load bearing member 76 engaged with the lower end 78 of the tubular member under the bias of a spring 80 positioned about the lower end of support post 42. The bearing member 76 may be downwardly retracted against the bias of spring 80 from engagement with the tubular member 48 when it is magnetically suspended. Toward that end, an electromagnetic coil or solenoid 82 is provided in surrounding relation to the bearing member 76.

Figure 4:
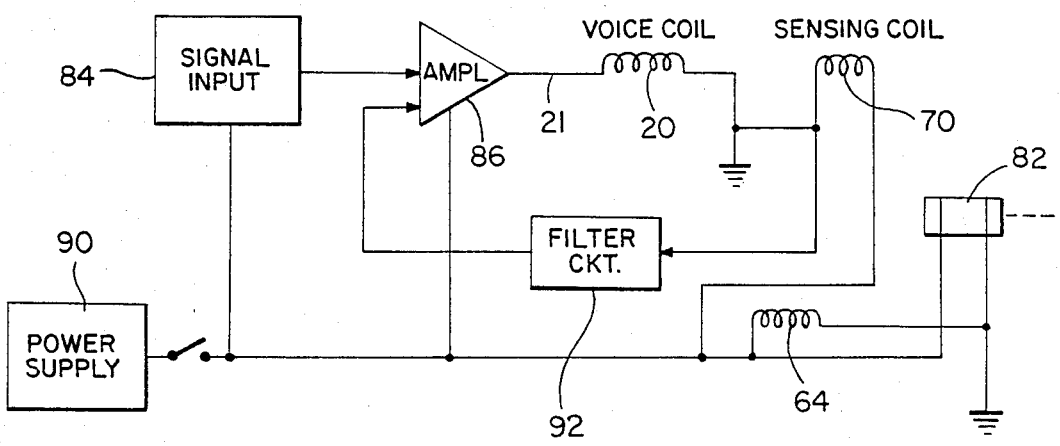

FIG. 4 illustrates a simplified control circuit which may be associated with the signal driving means for the speaker voice coil 20, including the signal input source 84 and the driving signal amplifier 86 to which the voice coil is coupled. The speaker is set into operation by closing of power switch 88 connecting a power supply 90 to all components including the signal input source 84, the amplifier 86, the sensing coil 70, the electromagnetic coil 64 and solenoid 82. The magnetic suspension means 54 will thereby be rendered operative by energization of coil 64 and the retraction of bearing 76 by solenoid 82. When the diaphragm is fully suspended magnetically, such condition is detected by sensing coil 70 to supply a feedback signal through filter circuit 92 to the amplifier to correspondingly regulate operation thereof in a more sensitive operational mode for distortion-free sound reproduction by the speaker diaphragm.

When magnetically suspended as hereinbefore described, the speaker assembly hermetically seals the enclosure housing 38 except for an annular gap 92 between the flange 34 of the diaphragm assembly framework 12 and the annular flange portion 94 of the housing as shown in FIG. 1 by virtue of which the aforementioned physical independence between the diaphragm 14 and housing 38 is maintained. The gap 92 serves as a self-regulating tuning port because of its dimensional variation in response to displacement of the speaker assembly when magnetically suspended during operation. Such gap arrangement of the present invention thereby replaces the tuning port orifice heretobefore provided in the side of a speaker enclosure to relieve a larger than necessary displacement of air generated during operation of the speaker.

In the embodiment illustrated herein, the enclosure housing 38 is formed from a composite sheet material having an inner layer 96 made of a sound-insulating material such as cork or fiber glass, an intermediate layer 98 made of a non-metallic substance such as wood, sheet rock or fibrous material, and an exterior skin 100 make of a non-magnetic sheet metal such as aluminum, copper or alloyed metals. Because of the slight movement of the speaker assembly relative to the housing and the magnetic field associated therewith, a small eddy current is produced to enhance the performance of the speaker. The composite layer structure of the housing 38 provides a magnetic shield to preserve such enhancement of performance, resulting from the suspension function of the magnetic field.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a loudspeaker having an enclosure, a diaphragm, means mounted by the enclosure for driving said diaphragm in response to an electrical signal applied thereto and means for supporting the diaphragm in operative relation to the driving means comprising, means mounted within the enclosure for producing a magnetic field, and magnetic armature means connected to the diaphragm for suspension thereof physically independent of the enclosure by coaction with the magnetic field.

2. The combination of claim 1 wherein said driving means includes a magnetic circuit and a voice coil supported by the diaphragm within said magnetic circuit.

3. The combination of claim 2 including an axially elongated member fixed to the diaphragm on which the magnetic armature means is mounted in non-interfering relation to the magnetic circuit of the driving means.

4. The combination of claim 3 wherein said magnetic field producing means comprises an annular magnet surrounding the axially elongated member and having a pole face operatively aligned in magnetic repulsive relation to the magnetic armature means.

5. The combination of claim 4 wherein said driving means further includes a signal amplifier connected to the voice coil and sensing means responsive to displacement of the diaphragm during drive thereof for modifying operation of the amplifier.

6. The combination of claim 5 wherein said operative relationship between the diaphragm and the driving means is established by axial orientation of the elongated member along a gravitational load axis.

7. The combination of claim 2 wherein said driving means further includes a signal amplifier connected to the voice coil and sensing means responsive to displacement of the diaphragm during drive thereof for modifying operation of the amplifier.

8. The combination of claim 7 wherein said operative relationship between the diaphragm and the driving means is established by axial orientation of the elongated member along a gravitational load axis.

9. The combination of claim 1 including an axially elongated member fixed to the diaphragm on which the magnetic armature means is mounted.

10. The combination of claim 9 wherein said magnetic field producing means comprises an annular magnet surrounding the axially elongated member and having a pole face operatively aligned in magnetic repulsive relation to the magnetic armature means.

11. In combination with a loudspeaker having a diaphragm, means for driving said diaphragm in response to an electrical signal applied thereto and means for supporting the diaphragm during drive thereof, comprising magnetic means for generating an axial force, and means applying said axial force to the diaphragm for suspension thereof in non-interfering relation to the driving means.

12. The combination of claim 11 wherein said driving means includes a voice coil supported by the diaphragm in coaxial relation thereto and a signal amplifier connected to said voice coil.

13. The combination of claim 12 including sensing means for detecting displacement of the diaphragm to a magnetic suspension position and means connecting the sensing means to the amplifier for regulating operation thereof.

14. The combination of claim 13 including an armature through which the axial force is applied to the diaphragm and an elongated member connecting the armature to the diaphragm.

15. The combination of claim 11 including an armature through which the axial force is applied to the diaphragm and an elongated member connecting the armature to the diaphragm.

16. In combination with an electrically driven speaker diaphragm assembly of a predetermined weight and a frame through which a gravitational axis is established, means suspending the diaphragm assembly for limited displacement along said gravitational axis without physical contact with the frame, comprising armature means connected to the diaphragm for displacement therewith along said axis and magnetic suspension means developing a force equal to said weight and applied along said axis to the diaphragm assembly for support thereof.

17. The combination of claim 16 including means for sensing said displacement of the diaphragm along the gravitational axis, amplifier means operatively coupled to the diaphragm for applying a driving signal thereto and feedback means connecting the sensing means to the amplifier means for regulating said driving signal.

18. The combination of claim 17 wherein said frame includes a housing enclosing the diaphragm assembly, and self-regulating port means dimensionally varied in response to said displacement of the diaphragm assembly for internal air relief of the housing.

19. The combination of claim 16 wherein said frame includes a housing enclosing the diaphragm assembly, and self-regulating port means dimensionally varied in response to said displacement of the diaphragm assembly for internal air relief of the housing.

20. The combination of claim 19 wherein said diaphragm assembly includes a conical framework having an annular flange spaced from the housing by an air gap constituting said tuning port, said air gap being dimensionally varied in response to said displacement of the diaphragm assembly to regulate venting of the housing through the tuning port.

21. In combination with a speaker diaphragm assembly, a housing enclosing the diaphragm assembly and driving means for displacement of the diaphragm assembly within the housing, means for supporting the diaphragm assembly comprising, means positioning the diaphragm assembly in spaced relation to the housing for establishing a tuning port therein and magnetic means carried by the diaphragm assembly and magnetically reacting with the positioning means for suspending the diaphragm assembly during said displacement thereof to maintain said tuning port open.

* * * * *